United States Patent [19]

Nitta

[11] Patent Number: 4,667,984

[45] Date of Patent: May 26, 1987

[54] DELIVERY SLIP SYSTEM AND METHOD FOR PRODUCING THE SAME

[75] Inventor: Katsukuni Nitta, Tokyo, Japan

[73] Assignee: Oji Yuka Goseishi Co., Ltd., Tokyo, Japan

[21] Appl. No.: 709,063

[22] Filed: Mar. 6, 1985

[30] Foreign Application Priority Data

Mar. 14, 1984 [JP] Japan ..... 59-36559
Dec. 24, 1984 [JP] Japan ..... 59-272489[U]

[51] Int. Cl.[4] ..... B41L 1/22; B42D 15/00

[52] U.S. Cl. ..... 282/8 R; 283/79; 283/80

[58] Field of Search ..... 282/1, 8 R, 23 R; 283/79, 80, 81

[56] References Cited

U.S. PATENT DOCUMENTS 3,987,960 10/1976 Gardiner ..... 283/79 X
4,121,961 10/1978 Brunette et al. ..... 283/81 X
4,407,524 10/1983 Trautlein ..... 283/79 X

*Primary Examiner*—Paul A. Bell
*Attorney, Agent, or Firm*—Oblon, Fisher, Spivak, McClelland & Maier

[57] ABSTRACT

A delivery slip system which comprises a delivery slip which is adhered on an article to be delivered, the delivery slip being provided with a necessary printing on the front and a pressure-sensitive layer in a predetermined area on the back thereof; a see-through waterproof covering film strip which is possible to write on having a width larger than said delivery slip; one or more copy slips having the same width as the delivery slip and disposed below said delivery slip; and a release paper strip applied to the back of the last and lowest copy slip; said delivery slip proper being bonded to the back of said covering film strip; said waterproof covering film strip being provided with an adhesive layer in the upper and lower edge portions on the back thereof; and said release paper strip adhereing to said waterproof covering film strip in the upper and lower edge portions thereof, and a method for producing the same.

16 Claims, 14 Drawing Figures

DELIVERY SLIP SYSTEM AND METHOD FOR PRODUCING THE SAME

FIELD OF THE INVENTION

This invention relates to a delivery slip system comprising a waterproof cover film, a delivery slip which is made of pulp paper bonded to the back of the cover film, and which is adhered on an article to be delivered, a set of copy slips which are made of pulp paper provided on the back of the delivery slip and a release paper provided on the back of the lowest copy slip and strippably bonded to areas of the waterproof cover film which are free from adhesion to the delivery slip, and to a method for producing the same.

BACKGROUND OF THE INVENTION

The delivery slip system which has been conventionally used by transporters generally comprises, as shown in FIGS. 1 to 5, a delivery slip 1 which is adhered on an article to be delivered, a copy slip 2 for the sender, a freight bill slip 3, a sales slip 4, a copy slip 5 for the issuer and a copy slip 6 to serve as a receipt, which are arranged from top to bottom in that order, and further comprises a transparent covering 10 which does not have writing properties by pencil or ball-point pen placed on the slip 1 and composed of a transparent synthetic resin film 7 coated with a pressure-sensitive adhesive on the left-hand and right-hand portions on the back thereof and two sheets of release paper 8 and 9 covering the adhesive-coated areas 8*a* and 9*a* on the film. Delivery slip 1, copy slip 2 for sender, freight bill slip 3, sales slip 4, copy slip 5 for issuer and copy slip 6 for receipt making, each slip being made of pulp paper, are bonded together at the left-hand end thereof and inserted between the film body 7 and the release paper 8 in the right-hand portion of the above covering, and the left end of the delivery slip 1 is bonded to the back of the film 7. Each of the slips 1 to 6 each is an opaque paper strip mainly composed of a pulp material and has a necessary printing, for example, a printed form including blanks which will be filled up with address, name of addressee, deliverer, kind of article, etc. The transparent synthetic resin film has an opaqueness of 3% or less and a haze of 5% or less. (See Japanese Patent Application (OPI) No. 18297/83. The term "OPI" as used herein refers to a "published unexamined Japanese patent application".)

The blanks 1*a*, 1*b*, etc. on the delivery slip 1 in such a delivery slip system (A) are filled up with address and name of addressee (1*a*), sender's name with or without address (1*b*), and other particulars as necessary, and these particulars are simultaneously copied on the slips 2 to 6. Thereafter, the delivery slip 1 together with the covering 10 is separated, and the release paper strips 8 and 9 are peeled off, whereby the adhesive-coated areas 8*a* and 9*a* are exposed. The delivery slip 1 and the covering 10 are then together adhered to an article (not shown) to be delivered via the adhesive areas 8*a* and 9*a* at an appropriate place (for example, on the top of the article) so that the delivery slip 1 can be seen through the film body 7. The delivery slip 1 is protected against rain and the like by the transparent film body 7.

Accordingly, the transparent synthetic resin film body 7 constituting the covering 10 and having a haze of 5% or less is a size larger than the delivery slip 1. Thus, in the conventional example shown, the film body 7 has extra portions 7*a*, 7*b* and 7*c* on the upper, lower and left sides, respectively, as compared with the delivery slip 1.

It is necessary in the prior art delivery slip system (A) that the covering 10 should be separated from the delivery slip 1 prior to filling up the blanks. After writing necessary particulars with a pencil, a ball-point pen or some other writing device to thereby attain simultaneous copying on the copy slips, the release paper strips 8 and 9 are peeled off from the covering 10, and the film body 7 is adhered onto an article to be delivered while holding the deliver slip 1 under pressure on the article and using sufficient care not to cause exposure of the slip 1. In this manner, the delivery slip 1 is prevented from contamination caused by rainwater or the like.

The see-through cover film 10 is essential to the delivery slip 1. Moreover, separation of the release paper strips 8 and 9 from the covering 10 takes time, and covering of the delivery slip 1 with the film body 7 while carefully holding the slip under pressure is particularly troublesome.

For the purpose of avoiding such difficulties encountered in using the prior art delivery slip system in which such transparent covering 10 which is impossible to write on with a ball-point pen, a pencil or the like is used as the topmost layer, a proposal has already been made, according to which an opaque synthetic paper sheet which is possible to write on is used as the topmost layer (Japanese Patent Application (OPI) No. 29699/83 and Japanese Utility Model Application (OPI) No. 133470/83). The delivery slip system according to the proposal comprises a delivery slip comprising an opaque synthetic paper strip which is possible to write on, having an opaqueness of 80 to 100% and having a printing with blanks to be filled up, several copy slips made of pulp paper having a width narrower than the delivery slip and which are disposed below the delivery slip, and a backing release paper strip fixed in position by means of an adhesive layer applied to the upper, lower and left edge portions of the delivery slip. Such a delivery slip system is produced by printing the delivery slip and copy slips having the same width (in the longitudinal direction) as the delivery slip proper using a printing machine such as a form printing press for stock certificate printing, cutting off the upper and lower edge portions of the copy slips to make a desired width, combining these with the delivery slip and backing the resulting system with a release paper strip.

The reason for producing copy slips having the same width as the delivery slip and then reducing the size of copy slips is due to the fact that the printing on the delivery slip and that on each copy slip must always be positioned overlappingly so that when the blanks on the delivery slip are filled up with particulars, the same particulars can be copied on the respective corresponding blanks on each copy slip through the aid of a carbonless or carbon-containing pressure-sensitive layer on the back of the delivery slip and a pressure-sensitive layer on the back of each copy slip. Accordingly the positioning in printing is conducted by taking advantage of the less appertures on one or both margins of paper sheets.

A further reason is that since the printing on the delivery slip should be located roughly in the middle part of the lengthwise width in order that the upper and lower edge portions of the slip can subsequently be adhered to the release paper sheet, the continuous paper sheet printed is fed in a continuous high-speed printing using the lead appertures on margins on both sides thereof so that the position of each blank on the delivery slip and the position of the corresponding blank on copy slips may not differ substantially. For this reason, copy slips having the same width as the delivery slip are first printed at a high speed in the continuous strip form and then deprived of the upper and lower edges to a necessary extent by cutting.

For providing the upper and lower edge portions of the delivery slip with an adhesive layer, a covering paper strip having the same width as the copy slips is placed on the release paper strip in the middle part thereof, an adhesive emulsion is applied by spraying to the whole exposed surface of the release paper strip and covering strip, and the delivery slip, the copy slips and the release paper strip with a covering or insert paper strip placed thereon are placed one upon another in sequence and then pressed together to give a delivery slip system in which the copy slips are contained in something like a tubular space formed by the delivery slip and release paper strip.

The process for producing the latter delivery slip system is disadvantageous in that the step off cutting of the upper and lower edge portions of copy slips following printing and preparation of copy slips having the same width as the delivery slip is required, which leads to a reduction in productivity, and further in that a positioning mechanism for the formation of an adhesive layer only in the upper and lower edge portions, a device for the application, by spraying, of an adhesive emulsion all over the release paper strip with a covering paper strip placed thereon, and a device for the insertion of an insert paper strip between the lowest copy slip and the release paper strip to thereby prevent the lowest copy slip from becoming adhered to the release paper strip on the occasion of writing in are required, so that the equipment becomes complicated and the productivity becomes poor.

Further, the latter delivery slip system has the disadvantage in that since the delivery slip is made of a synthetic resin film, the film swells by a solvent contained in a carbon layer provided at the desired portion on the back of the delivery slip and creases occur, resulting in deterioration of the appearance. Moreover, since the size precision is different between the synthetic resin film of the delivery slip and the pulp paper of the copy slip, after the printing is dried, the lengths of the printing lines for blanks printed thereon are slightly different and as a result, deviation of the printing lines on each slip tend to occur.

SUMMARY OF THE INVENTION

As a result of extensive investigations, it has been found that the above drawbacks of the prior art can be removed by uniting a see-through waterproof covering film strip which is possible to write on and a delivery slip proper into one body which can be adhered quickly and easily on an article to be delivered.

Accordingly, one object of the present invention is to provide a delivery slip system which comprises a delivery slip which is adhered on an article to be delivered and having a necessary printing on the front and a pressure-sensitive layer in a predetermined area on the back thereof; a see-through waterproof covering film strip which is possible to write on having a width larger than the delivery slip and having an opaqueness of 20 to 50% as determined by the method prescribed in JIS P-8138; one or more copy slips having the same width as the delivery slip and disposed below the delivery slip and a release paper strip applied to the back of the last and lowest copy slip; the delivery slip being applied to the back of the covering film strip; the waterproof covering film strip being provided with an adhesive layer in the upper and lower edge portions on the back thereof; and the release paper strip adhering to the waterproof covering film strip in the upper and lower edge portions thereof.

Another object of the present invention is to provide a method for producing such a delivery slip system which is easy to handle comprising a delivery slip applied to the back of a transparent or semitransparent waterproof covering film strip which it is possible to write on, copy slips having the same width as the delivery slip, and a backing release paper strip, in a continuous manner with markedly improved productivity.

This method can quickly meet a huge demand of the delivery slip system.

The method for producing the delivery slip system according to the present invention comprises applying a transparent adhesive to the back of a transparent or semi-transparent waterproof resin film which it is possible to write on in the form of a continuous strip having an opaqueness of 20 to 50% as determined by the method of JIS P-8138; drying the film; feeding the same to a combining mechanism; feeding a release paper sheet in the form of a continuous strip having the same width as the waterproof film to the combining mechanism; feeding, in the same direction as the waterproof film and release paper sheet, a set of a delivery slip and one or more copy slips which are made of pulp paper having a width narrower than the waterproof film but having the same width with one another to the combining mechanism in a manner such that the set of slips comes between the waterproof film and the release paper sheet and the front of the delivery slip faces the back of the waterproof film; making, in the combining mechanism, the delivery slip belonging to the set of slips applied to the back of the waterproof film except for the upper and lower margin portions thereof and at the same time causing the adhesive layer on the waterproof film to become strippably adhered to the release paper sheet; and cutting the resulting combination to a predetermined length to thereby provide a delivery slip system wherein the copy slips can be taken out freely from the tube-like space form by the waterproof film and release paper sheet.

DETAILED DESCRIPTION OF THE INVENTION

Figure 1:
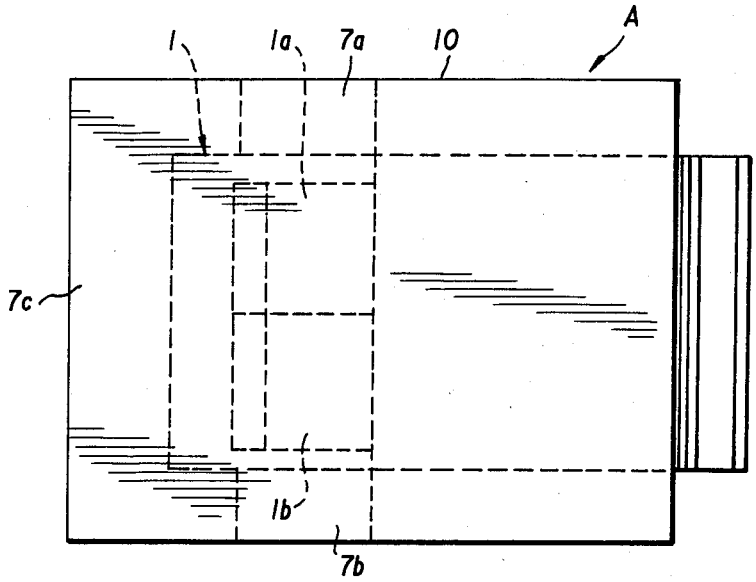
FIG. 1 PRIOR ART
FIG. 1 is a plan view of a prior art delivery slip system.
Figure 2:
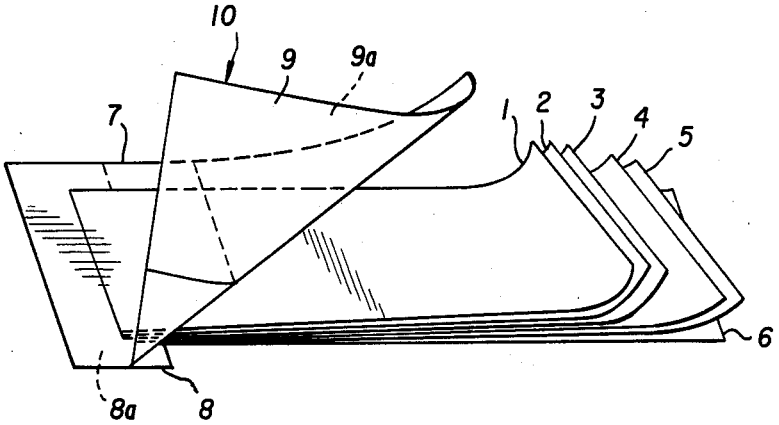
FIG. 2 PRIOR ART
FIG. 2 is a perspective view of the same.
Figure 3:
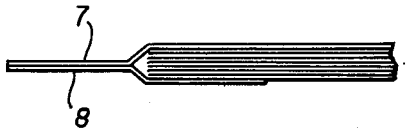
FIG. 3 PRIOR ART
FIG. 3 is a side view of a left-hand end portion of the same.
Figure 4:
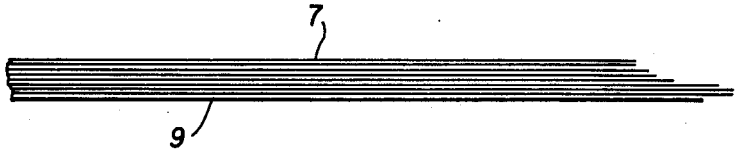
FIG. 4 PRIOR ART
FIG. 4 is a side view of a right-hand portion of the same.
Figure 5:
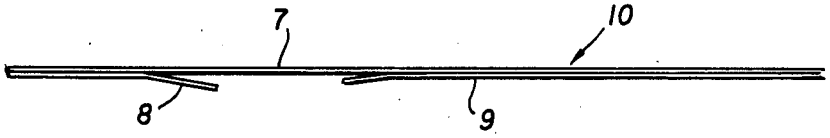
FIG. 5 PRIOR ART
FIG. 5 is a side view of that slip in the slip system which is adhered on an article delivered.

The delivery slip system according to the present invention is explained by reference to FIGS. 6 to 9.

The delivery slip system 11 comprises a delivery slip 12 adhered on an article to be delivered, a plurality of copy slips 13 and a release paper strip 14.

The slip 12 adhered on an article to be delivered comprises a delivery slip 17 made of pulp paper having a necessary printing 15 with blanks on the front surface thereof and a pressure-sensitive layer 16 on a predetermined area on the back thereof and a see-through waterproof covering resin film body 18 which it is possible to write on. The delivery slip 17 is integrally fixed on the back of the film body 18. The see-through waterproof film which it is possible to write on used in the present invention has an opaqueness of 20 to 50% as determined by the method prescribed in JIS P-8138, and may be transparent or semitransparent. Such a film preferably has an opaqueness of 40% or less and is made from a film-forming material such as a thermoplastic resin, e.g., polypropylene, low-density polyethylene, polyethylene terephthalate or polyamide; or a thermosetting resin, e.g., unsaturated polyester resin, acrylic resin, epoxy-acrylate resin or acrylic-urethane resin. The film is preferably mat-finished to improve the writing properties thereof by ink, pencil or the like.

Examples of such matted, see-through waterproof film which it is possible to write on includes the following films (1) to (7):

(1) A film formed on the delivery slip which is produced by coating the slip with a mixture of an emulsion or solution (varnish) of the above-mentioned thermosetting resin and 0.5 to 10% by weight of an inorganic filler and/or an incompatible resin filler incorporated therein by using a roll coater or a brush and curing the coating;

(2) A film obtained by melt kneading a mixture of the above-mentioned thermoplastic resin and 0.5 to 50% by weight of an inorganic filler and/or an incompatible resin filler incorporated therein and extruding the mixture;

(3) A film obtained by melt kneading a mixture of the above-mentioned thermoplastic resin and 0.5 to 50% by weight of an inorganic filler and/or an incompatible resin filler incorporated therein, extruding the mixture into a sheet-like material and uniaxially stretching the sheet at a stretch ratio of 2.5 or more [e.g. synthetic paper "Yupo TPG" (trademark), manufactured by Oji Yuka Goseishi];

(4) A film obtained by sandblast treating the surface of a film formed;

(5) A film obtained by treating the surface of a film formed with a good solvent for the film material and washing the surface with water (e.g. spring water);

(6) A film produced by contacting a resin film while still soft after its extrusion or calendering with an embossing roll and cooling the film to transfer the embossed pattern;

(7) A film obtained by extruding an ethylene-propylene block copolymer with or without subsequent uniaxial stretching.

The materials for forming films (4) to (7) may contain 0.5 to 7% by weight of an inorganic filler. These surface layers preferably have a thickness of 10 to 100 microns.

Figure 7:
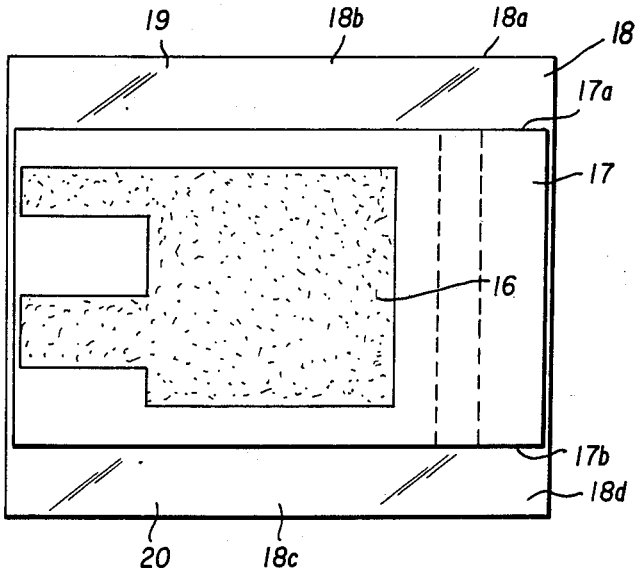
FIG. 7 is a backwise view of the delivery slip proper in the slip system.
Figure 8:
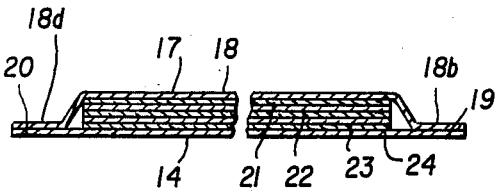
FIG. 8 is a magnified sectional view of the slip system as taken along the line VIII—VIII in FIG. 6.
Figure 13:
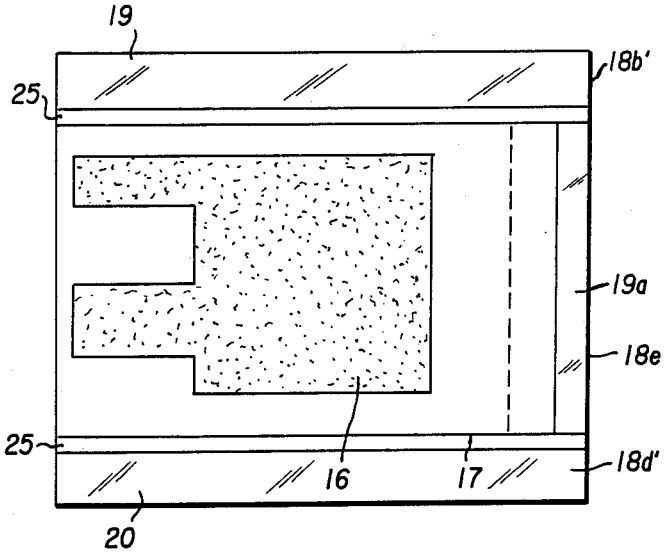
FIG. 13 is a backwise view of an alternative embodiment of the delivery slip proper.

The waterproof covering film body 18 has a width greater than the delivery slip 17 and is provided with an adhesive layer 19 on the back thereof in the portion between the upper edge 17*a* of the delivery slip 17 applied to the back of the film body 18 and the upper edge 18*a* of the waterproof covering film body 18, namely, in the upper edge portion 18*b* of the waterproof covering film body 18, and with an adhesive layer 20 in the portion between the lower edge 17*b* of the delivery slip 17 and the lower edge 18*c* of the waterproof covering film body 18, namely, in the lower edge portion 18*d* on the back of the waterproof covering film body 18 (cf. FIG. 7). As shown in FIG. 13 showing another embodiment, adhesive-free portions 25 may be provided between the upper edge portion 18*b*' and the lower edge portion 18*d*' and further an adhesive layer 19*a* may be left in the left edge portion for subsequent contact with the release paper strip 14.

It is not always necessary to provide the front surface of the waterproof covering film body 18 with a printing with blanks to be filled up. The front surface of the film body has no adhesive layer.

Copy slips 13, namely, copy slip 21 for agency, copy slip 22 for sender, copy slip 23 for reporting and copy slip 24 for issuer, which have the same longitudinal width as the above delivery slip 17 and a predetermined transverse width, are disposed such that the right edge indexing portions 21*a*, 22*a*, 23*a* and 24*a* of these copy slips 21, 22, 23 and 24 which are made of pulp papers are exposed with the upper and lower edges respectively in line. They are temporarily bonded to the delivery slip 17 at the left edge portion on the back thereof. The release paper strip 14 having the same shape and size as the waterproof covering film body 18 is applied to the back of the lowest copy slip 24 in the copy slips 13, and at the same time the adhesive layers 19, 20 and optionally 19*a* in the upper edge portion 18*b*, lower edge portion of 18*d* and the side edge portion of waterproof covering film body 18 are adhered on the release paper strip 14.

In this way, the copy slips 21, 22, 23 and 24 having the same width are fixedly held in order below the delivery slip 17 as if they were contained in an envelope.

The above copy slips 21, 22 and 23 are each provided with a pressure-sensitive layer in a predetermined area on the back thereof.

Figure 9:
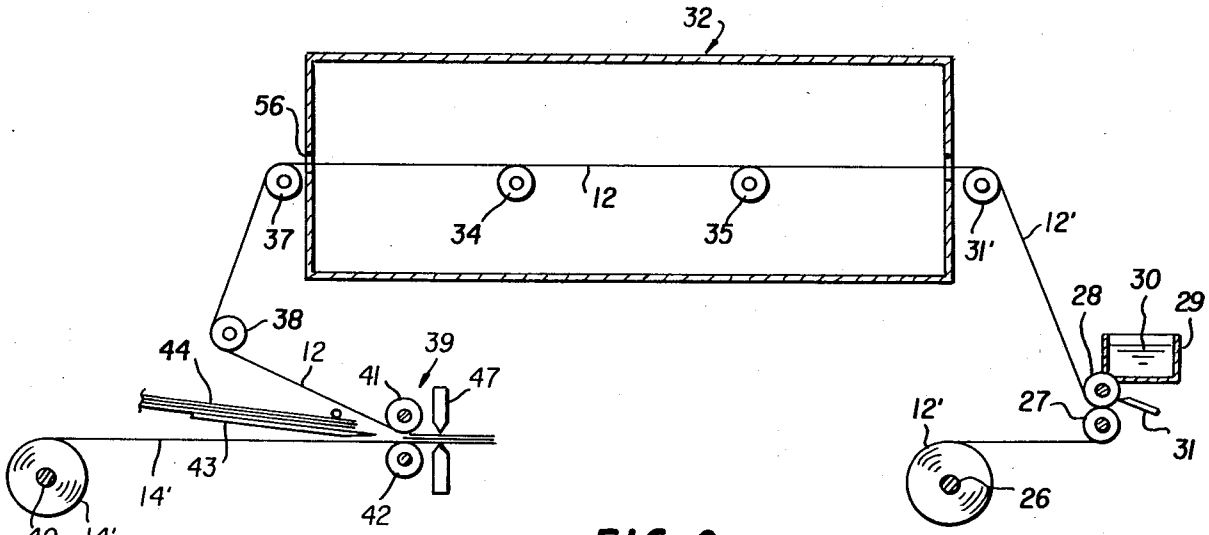
FIG. 9 is a schematic representation of a method for producing the delivery slip system according to the invention.

Another feature of the invention, namely the method for producing such a delivery slip system, is explained by reference to FIG. 9.

A transparent or semitransparent, waterproof film 12', such as a synthetic paper, which it is possible to write on at least on the front surface and taken up in the form of a continuous strip on a reel 26, is passed between a backup roll 27 and a coating roll 28 to apply a transparent adhesive 30 contained in a vessel 29 to the back of the waterproof film 12' by means of a doctor knife 31 to a desired thickness, whereby adhesive layers 19, 19*a* and 20 are formed. Via a guide roll 31', the waterproof film 12' then enters into a drying oven 32 through an inlet 33 and is led via intermediate rolls 34 and 35 and through an exit 36 to a guide roll 37. In the drying oven 32, the water or solvent contained in the adhesive 30 is evaporated and the film is dried to a desired extent.

The waterproof film 12' is then led from the exit 36 of the drying oven 32 to a combining mechanism 39 via guide rolls 37 and 38.

A release paper 14' taken up in the form of a continuous strip on a reel 40 and having the same width as the waterproof film 12' is led from the reel 40 to the combining mechanism 39.

The combining mechanism 39 comprises an upper roll 41 and a lower roll 42. A slip set 44 composed of a delivery slip proper 17 and copy slips 13 bonded together at the left edge with an adhesive and each having a printing with blanks to be filled up with address, sender, kind of article, delivery number, etc. on the surface thereof is guided onto a guide plate 43 for insertion of the slip set 44. The plate 43 is disposed before the combining mechanism 39 between the path for the waterproof film 12' from the guide roll 38 to the upper roll 41 and the path for the release paper 14' from the reel 40 to the lower roll 42. The slip set 44 is inserted between the waterproof film 12' running along the upper roll 41 and the release paper 14' running along the lower roll 42. While passing between the upper roll 41 and the lower roll 42, the waterproof film 12', the slip set 44 and the release paper 14' are combined to a unity in a predetermined state (cf. FIGS. 6 and 8). After each unity has been formed by the combining mechanism 39, the waterproof film 12' and the release paper 14' are severed by a cutting mechanism 47 into individual sets.

Figure 10:
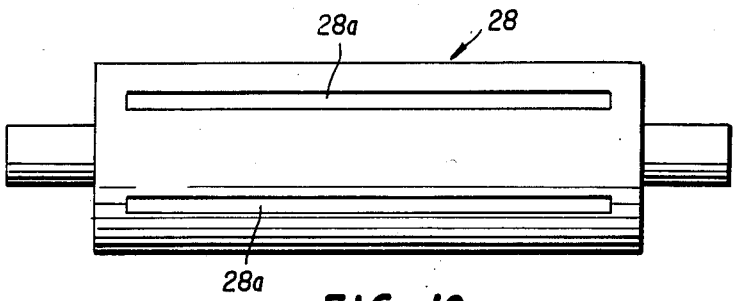
FIG. 10 is a front view of a coating roll.
Figure 11:
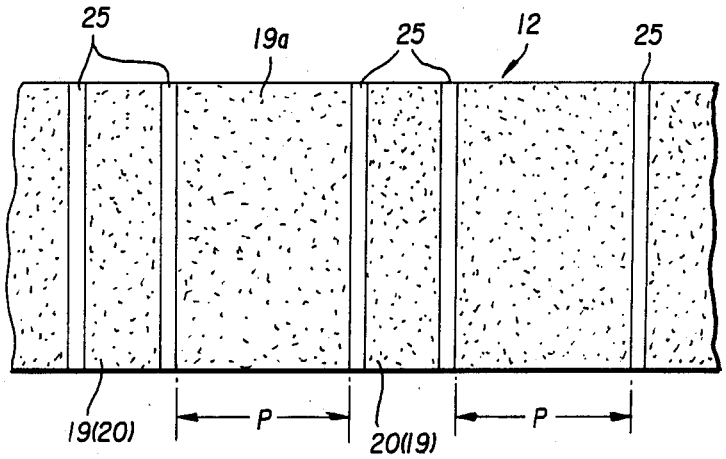
FIG. 11 is a partial plan view of the back of a continuous waterproof film strip with an adhesive layer formed on the back.

In this case, the circumferential surface of the coating roll 28 may be cylindrical, but it is preferred that the coating roll 28 has a circumference equal to the width of the copy slips 13 and, as shown in FIG. 10, further has impressions 28*a* and 28*a* on the circumferential surface for preventing adhesion of the adhesive on the corresponding areas on the waterproof film. This construction results in formation, on the back of the waterproof film 12' in the continuous strip form and by the adhesive applied by means of the coating roll 28, of an adhesive-coated region 19*a* having the same width as the waterproof film 12' and an adhesive-coated region 19, 20 having a predetermined width, each repeatedly appearing with an adhesive-free portion 25 lying therebetween, as shown in FIG. 11. The adhesive-free portion 25 facilitates the separation of the copy slips 13.

Figure 6:
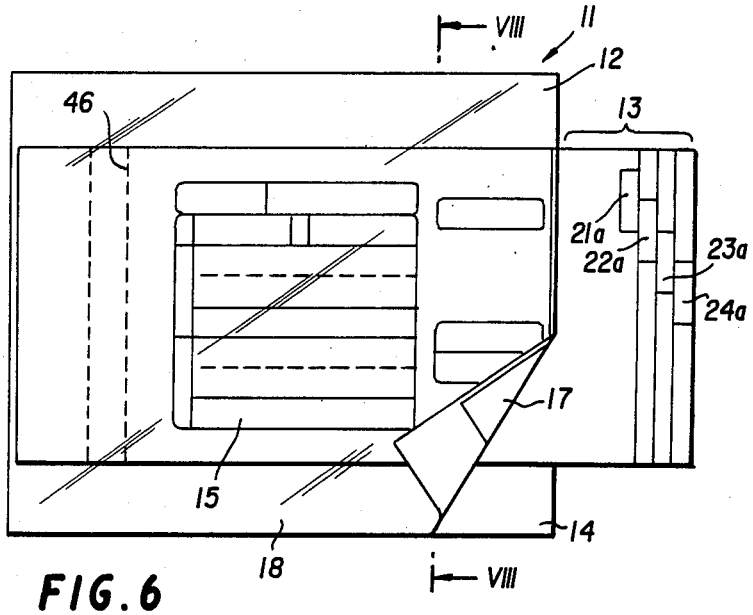
FIG. 6 is a plan view of a delivery slip system according to the invention, partly turned back.
Figure 14:
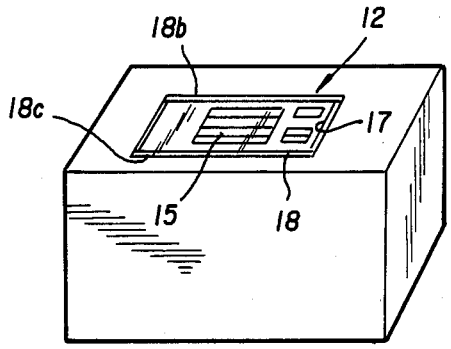
FIG. 14 is a plan view of another example of the slip adhered on an article to be delivered, which is bonded to the back of a waterproof cover film.
Figure 12:
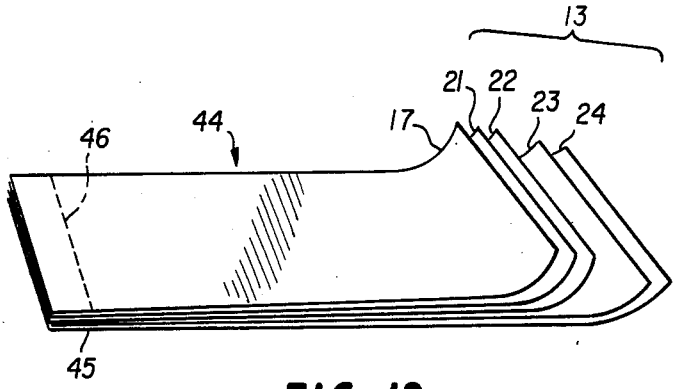
FIG. 12 is a perspective view of a set of slips used to produce the delivery slip system according to the invention.

The slip set 44 comprises, as shown in FIG. 12, the delivery slip 17 and the copy slips 21, 22, 23 and 24 having the same width as the delivery slip 17. All the slips are bonded at the left edge with an adhesive, and the left edge portion serves as a fixing portion 45. The copy slips 21, 22, 23 and 24 can easily be separated from the fixing portion 45 by taking advantage of a perforation 46. As shown in FIGS. 6 and 14, the delivery slip 17 and the copy slips 21, 22, 23 and 24 each has a necessary printing on the front surface with blanks 15 at the same corresponding positions and is provided with a pressure-sensitive noncarbon or carbon layer 16 on the back thereof.

The printing with blanks 15 on the delivery slip 17 can be seen through the waterproof film 12' on which it which is possible to write.

The waterproof film 12' has a width greater than the delivery slip 17, and the upper, lower and left edge portions 18*b*, 18*d* and 18*e* on the back thereof where the delivery slip 17 is not adhered remain exposed and allow the release paper strip 14 to strippably bond to the waterproof film 12' in these portions. The whole front surface of the delivery slip 17 is completely fixed on the back of the waterproof film 12', and the copy slips 21, 22, 23 and 24 occurring bonded below the delivery slip 17 can form the slip system by taking advantage of the perforation 46 provided in the fixing portion 45.

In this way, the waterproof film 12 with the delivery slip 17 fixedly bonded to the back thereof and the release paper sheet 14 are adhered together at the upper, lower and left edge portions 18*b*, 18*d* and 18*e*, with the slip set 13 lying therebetween, and the whole is fed to a cutting mechanism 47 and cut to a predetermined unit length of delivery slip system 11, for example, in the transverse direction in the middle of the adhesive-coated region 19 or 20 as shown in FIG. 11 to give a unit delivery slip system 11.

Therefore, the delivery slip system 11 takes a form such that the waterproof covering film body 18 and the backing release paper sheet 14, which are equal in shape and size, form something like a tube, and the copy slips 21, 22, 23 and 24 contained therein can be taken out therefrom from the left edge portion of the system.

The delivery slip system 11 according to the present invention can be written on the waterproof covering film body 18 in blanks which can be seen on the delivery slip 17 through the waterproof covering film body 18 with a writing device such as a ball-point pen using an oil-based ink or a pencil while seeing through the waterproof covering film body 18, whereby a state which is equivalent to that state of the blanks 15 of the delivery slip 17 filled up can be attained. At the same time, the particulars written in on the waterproof covering film body 12 are copied onto corresponding blanks on the copy slips 21, 22, 23 and 24 by the intermediary of the pressure-sensitive layer 16 on the back of the delivery slip proper 17 and the respective pressure-sensitive layers on the back of the copy slips 21, 22 and 23.

Then, while applying pressure onto the waterproof covering film body 18 at a place corresponding to the fixing portion 45 of the slip set 13 from above by the left hand, the copy slip 21, 22, 23 and 24 are separated by taking advantage of the perforation 46. Thereafter, the backing release paper strip 14 is removed and the delivery slip body 12 is applied to and adhered on an article to be delivered by applying strong pressure to the upper, lower and left edge portions of the waterproof covering film body 18, which are provided with an adhesive layer, whereby the slip body 12 is fixed on the article (cf. FIG. 14).

The delivery slip system 11 according to the present invention is advantageous in that the delivery slip 17 can be fixed on an article to be delivered in a very easy and simple manner without any fear of dislocation or contamination or breakage of the delivery slip 17.

The delivery slip system 11 according to the invention in which the see-through waterproof covering film body 18 which it is possible to write on and the delivery slip 12 are united into a delivery slip body which is adhered on an article to be delivered makes it possible to apply the delivery slip body to such an article in a simple and easy manner. In particular, the separation of copy slips is conducted in the manner of drawing out, so that the waterproof covering film body with the delivery slip proper fixedly attached to the back thereof is not required to be peeled off from the backing release paper sheet during the necessary procedure. This also makes its handling easy.

While the invention has been described in detail and with reference to specific embodiments thereof, it will be apparent to one skilled in the art that various changes and modifications can be made therein without departing from the spirit and scope thereof.

What is claimed is:

1. A delivery slip systems which comprises:

(a) a delivery slip which, in use, in adhered on an article to be delivered, said delivery slip having a front, a back, a top, a bottom, a left edge, and a right edge and being provided with printing on its front and a pressure-sensitive transfer layer on its back;

(b) a see-through, waterproof covering film strip treated so that it is possible to write on said covering film strip with ink or pencil leaving marks on said covering film strip, said covering film strip being adhered to the front of said delivery slip, said covering film strip extending above the top, beneath the bottom, and beyond at least one edge of said delivery slip, said covering film strip being provided with an adhesive layer on its back on at least its upper and lower edge portions extending above the top and beneath the bottom of said delivery slip;

(c) one or more copy slips disposed beneath and in register with said delivery slip, each one of said one or more copy slips having a front, a back, a top, a bottom, a left edge, and a right edge, the dimension from the top to the bottom of each one of said one or more copy slips being the same as the dimension from the top to the bottom of said delivery slip, each one of said one or more copy slips being provided with printing on its front and all but the lowermost one of said one or more copy slips having a pressure sensitive transfer layer on its back; and (d) a release paper strip adhering to the adhesive layer on the upper and lower edge portions of said covering film strips, said release paper strip and the unit composed of said dlivery slip and said covering film strip forming an envelope open along one edge for said one or more copy slips.

2. a delivery slip system as recited in claim 1 wherein said delivery slip is made of pulp paper.

3. A delivery slip system as recited in claim 1 wherein said one or more copy slips are made of pulp paper.

4. A delivery slip system as recited in claim 1 wherein said covering film strip is made of a semi-transparent film having an opaqueness of 20% to 50% as measured by the method of JIS P-8138.

5. A delivery slip system as recited in claim 1 wherein:

(a) said covering film strip is also provided with an adhesive layer on its back on a lateral edge portion extending beyond said at least one edge of said delivery slip and (b) said release paper strip adheres to the adhesive layer on the lateral edge portion of said covering film strip.

6. A delivery slip system as recited in claim 1 wherein:

(a) the system comprises a plurality of copy slips and (b) a lateral edge portion on each one of said plurality of copy slips extends outside of the envelope formed by said release paper and the unit composed of said delivery slip and said covering film strip.

7. A delivery slip system as recited in claim 6 wherein each successively lower one of said plurality of copy slips extends further outside of the envelope formed by said release paper strip and the unit composed of said delivery slip and said covering film strip.

8. A delivery slip system as recited in claim 1 wherein said one or more copy slips are temporarily bonded to said delivery slip.

9. A delivery slip system as recited in claim 8 wherein said one or more copy slips are temporarily bonded to said delivery slip adjacent said at least one edge of said delivery slip.

10. A delivery slip system as recited in claim 1 wherein said covering film strip is produced by coating a film with a mixture of an emulsion or solution of a thermosetting resin and 0.5% to 10% by weight of an inorganic filler and/or an incompatible resin filler.

11. A delivery slip system as recited in claim 1 wherein said covering film strip is produced by melt kneading a mixture of a thermosetting resin and 0.5% to 50% by weight of an inorganic filler and/or an incompatible resin filler and extruding the mixture.

12. A delivery slip system as recited in claim 1 wherein said covering film strip is produced by melt kneading a mixture of a thermoplastic resin and 0.5% to 50% by weight of an inorganic filler and/or an incompatible resin filler and extruding the mixture and then uniaxially stretching the mixture at a stretch ratio of 2.5 or more.

13. A delivery strip system as recited in claim 1 wherein said covering film strip is produced by sandblast treating the surface of the film strip.

14. A delivery slip system as recited in claim 1 wherein said covering film strip is produced by treating the surface of the film strip with a solvent and then washing the surface with water.

15. A delivery slip system as recited in claim 1 wherein said covering film strip is produced by calendering the film strip with an embossing role.

16. A delivery slip system as recited in claim 1 wherein said covering film strip is produced by extruding an ethylene-propylene block copolymer.

* * * * *